US010479634B2

(12) United States Patent
Provera

(10) Patent No.: US 10,479,634 B2
(45) Date of Patent: Nov. 19, 2019

(54) MACHINE AND METHOD FOR PRODUCING BOBBINS OF STRETCH FILM

(71) Applicant: AMUT S.P.A., Novara (IT)

(72) Inventor: Vander Provera, Novara (IT)

(73) Assignee: AMUT S.P.A., Novara (IT)

( * ) Notice: Subject to any disclaimer, the term of this patent is extended or adjusted under 35 U.S.C. 154(b) by 100 days.

(21) Appl. No.: 15/571,056

(22) PCT Filed: May 5, 2016

(86) PCT No.: PCT/EP2016/060129
§ 371 (c)(1),
(2) Date: Nov. 1, 2017

(87) PCT Pub. No.: WO2016/177851
PCT Pub. Date: Nov. 10, 2016

(65) Prior Publication Data

US 2018/0162669 A1 Jun. 14, 2018

(30) Foreign Application Priority Data

May 5, 2015 (EP) ..... 15166350

(51) Int. Cl.
*B65H 19/22* (2006.01)
*B65H 18/02* (2006.01)
(Continued)

(52) U.S. Cl.
CPC ..... *B65H 19/2223* (2013.01); *B65H 18/021* (2013.01); *B65H 18/26* (2013.01);
(Continued)

(58) Field of Classification Search
CPC .. B65H 18/021; B65H 18/26; B65H 19/2223; B65H 19/2253; B65H 19/26; B65H 19/30
See application file for complete search history.

(56) References Cited

U.S. PATENT DOCUMENTS 4,541,583 A 9/1985 Forman et al.
4,715,552 A 12/1987 Matsumoto
(Continued)

OTHER PUBLICATIONS

European Search Report and written opinion dated Dec. 2, 2015 for priority application No. 151663507.
(Continued)

*Primary Examiner* — William E Dondero
(74) *Attorney, Agent, or Firm* — Silvia Salvadori

(57) ABSTRACT

A winding machine (10) is disclosed comprising at least one reel holder (12) mounted on a supporting frame (11) and rotatable around its own axis (13), and a plurality of reels (1-4) mounted on the holder (12) and integrally rotatable therewith so that at least one first reel (1) is in at least one operative winding position of a bobbin (5). It is further described a respective method for the in-line winding of bobbins (5) of stretch film (6), comprising the steps of rotating a core (7) on a reel (1) in an operative winding position to wind the film (6) onto the core (7), positioning a contact roll (15*a*) in at least one proximal contacting position in which it contacts the winding bobbin (5) for facilitating the peripheral winding of the stretch film (6) on the core (7), bringing the reel (1) from the operative winding position of the bobbin (5) to an operative unloading position of the bobbin, positioning an accompanying roll (15*b*) in at least one proximal contacting position in which it contacts the bobbin (5) for facilitating the peripheral winding of the stretch film (6) on the bobbin (7), transversally cutting the stretch film (6) and unloading the bobbin (5). The movement of the contact roll (15*a*) and the accompanying roll (15*b*) is carried out by means of electric actuators (18*a*, 18*b*).

14 Claims, 10 Drawing Sheets

(51) Int. Cl.
*B65H 19/30* (2006.01)
*B65H 18/26* (2006.01)
*B65H 19/26* (2006.01)

(52) U.S. Cl.
CPC ..... *B65H 19/2253* (2013.01); *B65H 19/26* (2013.01); *B65H 19/30* (2013.01); *B65H 2301/41894* (2013.01); *B65H 2403/7254* (2013.01); *B65H 2404/432* (2013.01); *B65H 2404/433* (2013.01); *B65H 2404/434* (2013.01); *B65H 2408/23157* (2013.01); *B65H 2515/34* (2013.01); *B65H 2515/704* (2013.01); *B65H 2553/51* (2013.01); *B65H 2555/10* (2013.01); *B65H 2555/13* (2013.01); *B65H 2701/1752* (2013.01)

(56) References Cited

U.S. PATENT DOCUMENTS 5,845,867 A 12/1998 Hould et al.
2004/0245859 A1 12/2004 Sieber

OTHER PUBLICATIONS

International Search reportand written opinion dated Jul. 22, 2016 for PCT/EP2016/060129.

MACHINE AND METHOD FOR PRODUCING BOBBINS OF STRETCH FILM

RELATED APPLICATIONS

This application is a U.S. national phase application of international application number PCT/EP2016/060129, filed 05 May 2015, the contents of each of which are hereby incorporated by reference as if set forth in their entireties.

FIELD OF THE INVENTION

The present invention concerns a winding machine to wind stretch films in bobbins. The invention is especially used in the production lines of plastic films to produce bobbins made by winding a continuous web of film.

PRIOR ART

Systems for producing plastic films, for example polyethylene films (the so-called "stretch film"), typically comprise a plurality of cascade steps for the direct in-line production by extrusion of film bobbins. In particular, the production lines of plastic films typically comprise a first step in which a continuous film web is produced by extrusion from a melted plastic mixture. The film output from the extruder passes through a plurality of intermediate cooling steps to finally come to a winding machine having the task of winding the film around tubular centers (typically made of cardboard and called "cores") in order to form film bobbins.

As the web is wound around the core, the diameter of the bobbin gradually increases. Once the bobbin reaches a specific size, the film web is cut so that the portion of web downstream of the cut will wind around the bobbin being completed, while the portion of the web upstream of the cut will wind around a new core to form a new bobbin. In this way, a plurality of film bobbins can be uninterruptedly produced from a single continuous web formed by the upstream extruder. Since the film web is produced uninterruptedly, in order to prevent delays or errors that could block the entire production line, the above described steps have to be carried out rapidly and in reliable and repeatable ways.

Alternatively, systems in which large bobbins (the so-called "jumbo" bobbins) are initially formed to be subsequently fed to a winding machine able to produce film bobbins having smaller diameters and widths, are also known.

Winding machines for producing bobbins of stretch film, in which the cardboard core is fitted around a rotating shaft (called reel) rotated for winding the film around the core, are known. These winding machines are provided with a plurality of reels arranged on a holder rotatable around an axis. By rotating the holder, each reel is moved to take specific operative positions. Typically, at least three operative positions are provided: a position for loading a new core onto a free reel, a position for winding the film around the core, and a position for unloading the finished bobbin from the reel. By rotating around its own axis, the holder allows the reels to be simultaneously positioned in the above said operative positions.

Typically, the reel in the winding position is rotated by means of a motorized contact roll which facilitates the winding of the film around the core and allows to expel the air that could be trapped among the windings of the bobbin by applying a pressure on the film being wound around the core. As the diameter of the bobbin increases, the roll is moved radially outwards the bobbin.

Some winders are provided with further auxiliary rolls pressing the winding bobbin during the rotation of the reel holder in order to prevent air from becoming trapped, due to the cut, among the last windings of the bobbin being completed. Therefore, after the film has been cut, auxiliary rolls keep on pressing the film on the bobbin until the winding is completed. Also these rolls have to be moved in accurate and reliable ways, in order to prevent the formation of film wrinkles on the last layers of film.

The rolls are typically moved by means of swinging arms rotatable around a rotation axis parallel to the rotation axis of the reel holder. The rolls are placed at the end of the arms which are moved, for example, by means of pneumatic actuators. In particular, the arms are rotated by means of pistons and cylinders connected to a pneumatic circuit adapted to supply a pressure fluid inside the cylinders.

It is of fundamental importance to control the various pneumatic actuators, especially when the winding machine itself is used to sequentially produce different kind of bobbins (for example hand, machine and jumbo bobbins) during the film production. Basically, the various types of bobbins differ from each other on the basis of the diameter of the core (which varies, for example, depending on the thickness of the cardboard forming the core) and the final diameter to be reached by the bobbin.

Therefore, because the moving and positioning of various rolls are critical operations, if they are not carried out in an accurate, repeatable and reliable way, can cause offsets in positioning the rolls thereby causing air entrapment inside the bobbin. Proper operation of pneumatic systems in winding machines is quite critical and can be adversely affected even by minimal pressure changes that may inadvertently occur over time.

For these reasons, pneumatic systems of winding machines have to be periodically checked and cleaned in order to prevent clogging of ducts and valves or pressure drops in the pneumatic circuit which could adversely affect the proper winding and the quality of the final bobbins. Therefore, to carry out periodic maintenance of pneumatic circuits, the entire production line has to be stopped. This causes a slowdown of the production, a cost of manpower for servicing and an overall decrease in efficiency of the whole production line.

SUMMARY OF THE INVENTION

Object of the present invention is to overcome the known art problems briefly discussed above, and to provide a winding machine able to produce different kinds of bobbins in a more reliable way and requiring less maintenance with respect to the winders of the known art.

It is a further object of the present invention to provide a more effective method for winding bobbins with respect to those of the known art.

The present invention achieves these and others objects by means of a winding machine according to claim 1 and the respective dependent claims, and a method according to claim 10 and the respective dependent claims.

In particular, according to the present invention, the winding machine comprises a supporting frame and at least one reel holder mounted on the supporting frame. Each holder is rotatable around its own axis and is provided with a plurality of reels integrally rotatable therewith so that at least one first reel is in at least one operative winding position of a bobbin.

The winding machine comprises a contact roll adapted to cooperate with the first reel in an operative winding position. The contact roll is movable between at least one proximal contacting position, where it contacts the bobbin being wound for facilitating the peripheral winding of the stretch film onto the bobbin, and at least one distal position from the bobbin.

The winding machine comprises an accompanying roll movable between at least one distal position from the winding bobbin and at least one proximal contacting position wherein it contacts the bobbin. The accompanying roll is adapted to facilitate the peripheral winding of the stretch film during the rotation of the reel holder, for switching the first reel from the operative position for winding the bobbin to an operative position for unloading the bobbin.

The contact roll and the accompanying roll are respectively coupled with a first operating arm and a second operating arm both rotatable around respective rotation axes parallel to the rotation axis of the bobbin.

According to an aspect of the present invention, the rotation of the operating arms is caused by electric actuators.

The electric actuators are supplied by at least one electric power circuit connected to a logic control unit which controls the electric current output to each actuator.

With this solution, the system for moving the rolls is made much easier with respect to actuators of the known art in which a pneumatic circuit is required in order to feed a pressure fluid to the actuators. In fact, for the electric power circuit no particular maintenance is required in order to assure a reliable production of different kind of bobbins. Furthermore it was found that, by means of electric actuators, the positioning of rolls is more accurate and more rapid with respect to winders in which the movement of rolls is caused by pneumatic actuators. Moreover, the positioning of rolls is more reliable and can be repeated over time, further facilitating the change of operation settings for processing bobbins of different sizes and different types of films to be wound.

In this way, it is possible to reduce maintenance costs and keep the production line operating for a long time without interruptions, with a generally greater efficiency and reliability with respect to solutions of the known art.

According to a particular aspect of the present invention, the electric actuators are of the linear type. For example, electric actuators comprise an electric motor, preferably of the brushless type, and a linear element coupled with the electric motor by means of a transmission converting the rotary motion of the electric motor into linear motion, for example by means of a screw/nut thread coupling. The operating arms are preferably pivoted to the frame and rotated around respective pins by means of the displacement (for example the linear displacement) caused by the electric actuators.

According to a particular aspect of the present invention, the winding machine comprises means for detecting the current absorbed by the electric actuators. In particular, the logic control unit adjusts the current output from the electric power circuit depending on the current absorbed by the electric actuators. For example, the logical unit can adjust the current output from the electric power circuit so that the electric actuators generate a specific torque whereby at least the contact roll applies a given pressure on the film being wound, for example a constant pressure independent of the bobbin diameter which changes during winding.

The winding machine according to the present invention further comprises means for determining the position of the rolls with respect to the bobbin being wound. In an embodiment, the means for determining the position comprise at least one encoder, preferably of the absolute type. Advantageously, in case of linear electric actuators, the absolute encoder can be housed inside the electric actuator for detecting the number of revolutions made by the electric motor. The logic control unit can determine the position of the rolls depending on the number of revolutions made by the electric motor, for example by means of a map previously obtained by experimental tests.

According to a particular aspect of the present invention, the winding machine further comprises a threading-up electric motor, i.e. a motor allowing a reel having a new core loaded thereon to be rotated at a speed suitable for starting to wind a new bobbin. In particular, before cutting the film, a second reel having a new core loaded thereon is advantageously rotated so that, as a result of a rotation of the reel holder, it reaches a winding position at a rotating speed close to that of the contact roll (threading-up).

Preferably, the threading-up electric motor can be coupled with the second reel having a new core loaded thereon by means of a magnetic coupling. The magnetic coupling between the reel and the electric motor allows to carry out the thread-up during the holder rotation without having to motorize each single reel with a respective threading-up motor. Advantageously, this solution allows the reels to be mounted in the neutral position in the holder thereby simplifying the structure of the reel holder.

According to a further aspect of the present invention, the winding machine comprises an electromagnetic brake for braking the rotation of a reel having a finished bobbin loaded thereon in unloading position. In particular, once the bobbin has been finished it still rotates by inertia. The rotation of the finished bobbin can be stopped by the electromagnetic brake thereby speeding up unloading operations. The magnetic coupling between the electromagnetic brake and the reel having a finished bobbin in unloading position allows to simplify the holder structure without having to mount a brake on each reel.

A further object of the present invention is a method for the in-line winding of bobbins of stretch film in a winding machine comprising at least one reel holder mounted on a supporting frame and rotatable around its own axis, and a plurality of reels mounted on the holder and integrally rotatable therewith so that at least one first reel is in an operative winding position of a bobbin. The method comprises a step of rotating a core on a reel in an operative winding position and a step of positioning a contact roll in at least one proximal contacting position where it contacts the winding bobbin for facilitating the peripheral winding of the stretch film on the core.

When the bobbin reaches a specific diameter close to the one provided for completing it, the holder is rotated in order to bring the reel from the operative winding position to an unloading position to unload the bobbin.

Preferably, a first rotation is made by the holder in order to bring the reel being wound to a second operative winding position. During the holder rotation, the contact roll is kept in contact with the bobbin being wound and an accompanying roll is moved to a determined distance from the bobbin being wound.

According to an aspect of the present invention, as previously described referring to the winding machine according to the present invention, the contact roll and the accompanying roll are moved by means of electric actuators.

According to an aspect of the present invention, the method further comprises a step of detecting the position of the rolls with respect to the bobbin being wound. Advantageously, the rolls are moved depending on the position detected by encoders, for example by moving the rolls by a feedback control of the supply current provided to the electric actuators depending on the detected position of the rolls.

For example, an embodiment can provide that the movement of the accompanying roll is based on the position of the rolls with respect to one another. Preferably, once the first reel has reached the above said second winding position, the accompanying roll is positioned at a certain distance from the bobbin (preferably at a distance of less than one millimeter). Then, the accompanying roll is brought into contact with the bobbin and, at the same time, the contact roll is brought to a distal position from the bobbin. The contact roll and the accompanying roll contact the bobbin being wound for a split second (typically of the order of a millisecond). The holder is then rotated so that the first reel (carrying the bobbin being wound) reaches the cutting position and the following unloading position to unload the bobbin. The accompanying roll is simultaneously moved so as to be kept in contact with the bobbin being wound during the holder rotation.

As previously described for the winding machine according to the invention, the method further comprises a step of detecting the current absorbed by the electric actuators, so that during the film winding, the rolls are moved between a first proximal contacting position and a second proximal contacting position depending on the detected current absorption.

In this way, both the contact roll and the accompanying roll are moved in order to apply a certain pressure on the bobbin while the film is wound and accompanied to the final winding step.

When the bobbin being wound reaches the unloading operative position, a second reel having a new core previously loaded thereon reaches the operative winding position. During this step, preferably the second reel carrying a new core is rotated at a speed close to that of the contact roll. This operation (threading-up) is preferably carried out by means of an electric motor magnetically coupled with the reel having a new core loaded thereon. In this way, the threading-up can be carried out during the rotation of the reel holder without any contact among the parts. This solution allows the threading-up to be carried out by means of a single motor, thereby without coupling a threading-up motor with each reel that would result in the reel holder excessively weighted down. As the second reel with the new core reaches the operative winding position, the contact roll is moved so as to press the film on the new core and subsequently the film is transversely cut. The portion of the film upstream of the cut begins to wind onto the new core, while the portion downstream of the cut is wound around the bobbin loaded on the first reel and brought to the unloading position. Once the bobbin is finished, the accompanying roll is brought to a distal position from the bobbin ant the reel with the finished bobbin is preferably braked by an electromagnetic brake in order to allow the bobbin to be unloaded from the reel.

BRIEF DESCRIPTION OF THE DRAWINGS

Further aspects and advantages of the present invention will become more evident from the following description, made for illustration purposes and without limitation, with reference to the accompanying schematic drawings, in which.

METHODS FOR IMPLEMENTING THE INVENTION

Figure 1:
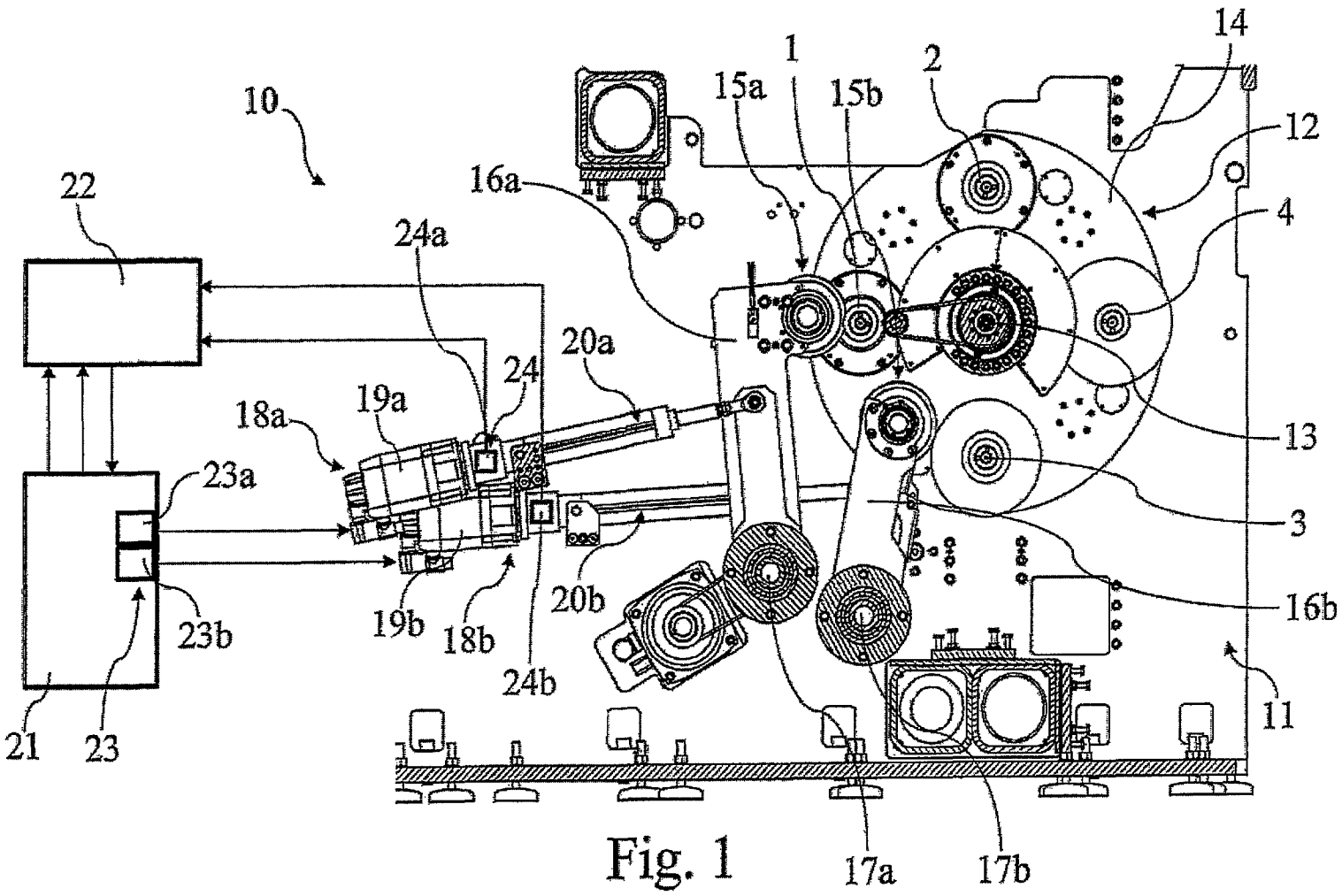
FIG. 1 is a sectional view of an embodiment of the winding machine according to the present invention.

FIG. 1 shows a winding machine 10 comprising a supporting frame 11 and at least one reel holder 12 mounted on the supporting frame 11 and rotatable around its own axis 13. In the embodiment shown in FIGS. 1-6 a single reel holder 12 is shown for greater simplicity in explanation. It is however contemplated that in further embodiments the winding machine 10 can comprise a plurality of reel holders 12 mounted on the supporting frame 11 for winding bobbins of stretch film, which are for example produced in line by an upstream extruder. In the latter case, a film web produced by the upstream extruder is cut into bands of smaller width, each being led at the inlet of a respective reel holder 12 to be independently wound each in different bobbins.

Each reel holder 12 is provided with four reels 1-4 preferably arranged 90° from each other. Reels 1-4 are integrally rotatable with the holder 12 so that at least one first reel 1 is in at least one operative winding position of a bobbin 5. In particular, the holder 12 comprises two flanges 14 (each figure showing only one of the two flanges) and each reel 1-4 is supported between the two flanges 14 of the holder 12. By rotating the holder 12, the reels 1-4 move among different operative positions described in more detail hereinafter in the present description.

The winding machine 10 further comprises a contact roll 15*a* adapted to cooperate with a first reel 1 at an operative winding position, and an accompanying roll 15*b* adapted to cooperate with the above said reel, during rotation of the reel holder in order to bring the reel 1 from the operative winding position to an unloading operative position (position taken by the reel 1 shown in FIG. 1 as a result of a counterclockwise 90° rotation of the reel holder 12).

The contact roll 15*a* and the accompanying roll 15*b* are respectively coupled with a first operating arm 16*a* and a second operating arm 16*b* both rotatable around respective rotation axes 17*a*, 17*b* parallel to the rotation axis of the bobbin. Preferably, the rotation axes 17*a*, 17*b* of the operating arms 16*a*, 16*b* and the rotation axis of the bobbin 5 are parallel to the rotation axis 13 of the reel holder 12. The operating arm 16*a*, 16*b* are rotated by means of electric actuators 18*a*, 18*b*.

Preferably, the electric actuators 18*a*, 18*b* are of the linear type and comprise preferably brushless electric motors 19*a*, 19*b* and each comprises a linear element, for example operating bars 20*a*, 20*b* coupled with the respective electric motors 19*a*, 19*b* by a coupling that converts the rotary motion of the electric motor into a linear motion, for example by a screw/nut thread coupling. The rotation of the electric motors 19*a*, 19*b* in one way or the other causes the operating bars 20*a*, 20*b* to be moved forward or backward. The first operating arm 16*a* and the second operating arm 16*b* are coupled with a first electric actuator 18*a* and a second electric actuator 18*b*, respectively. In particular, each operating bar 20*a*, 20*b* of the respective electric actuator 18*a*, 18*b* is constrained to a respective operating arm 16*a*, 16*b*.

By means of the electric actuators it is therefore possible to move the rolls 15*a*, 15*b* between at least one proximal contacting position wherein it contacts the bobbin being wound and at least one distal position from the bobbin.

In particular, the winding machine 10 comprises a circuit providing the power supply 21 to the electric actuators 18*a*, 18*b* and a logic control unit 22 adapted to adjust the current output from the electric power circuit 21 to the electric actuators 18*a*, 18*b*. The logic control unit 22 selectively drives the electric actuators 18*a*, 18*b* by adjusting the supply power provided by the power circuit 22 to each electric actuator 18*a*, 18*b*. The current can be adjusted in several ways known per se in the art, for example by means of PWM regulators or similar.

The winding machine 10 further comprises means 23 for detecting the current absorbed by the electric actuators 18*a*, 18*b*. The means 23 for detecting the absorbed current can comprise for example two amperometers 23*a*, 23*b* (for example connected to the electric power circuit 21) used by the logic control unit 22 to determine the current absorbed by the respective electric actuators 18*a*, 18*b*.

In this way, the logic control unit 22 can adjust the current output from the electric power circuit 21 depending on the current absorbed by the electric actuators. In particular, the logic control unit 22 adjusts the supply current provided to the electric actuators 18*a*, 18*b* in order to generate a specific torque adapted to move the operating arms 16*a*, 16*b* and, therefore, the rolls 15*a*, 15*b* depending on the detected current absorption. In this way the logic control unit 22 adjusts the supply current provided to the electric actuators 18*a* 18*b* so that at least the contact roll 15*a* applies a predetermined pressure to the bobbin 5 being wound. The current absorption detected by means of the amperometers 23*a*, 23*b* is a measure indicating the pressure applied by the corresponding contact roll 15*a* to the bobbin 5 being wound. Therefore, the present solution allows the supply current provided to the electric actuators 18*a*, 18*b* to be feedback controlled so that the rolls 15*a*, 15*b* apply to the bobbin 5 a predetermined pressure, for example a constant pressure, during the film winding through the whole winding step, thereby preventing the formation of air bubbles among the layers of wound film.

The winding machine 10 further comprises means 24 for detecting the position of the rolls 15*a*, 15*b* with respect to the bobbin 5 being wound. In the embodiment shown in FIGS. 1-6, the electric actuators 18*a*, 18*b* are provided with absolute encoders 24*a*, 24*b* allowing the logic control unit 22 to detect the number of revolutions made by the respective electric motor 19*a*, 19*b* and to determine the position of the rolls 15*a*, 15*b* with respect to the bobbin 5.

However, in additional embodiments position sensors can also be provided, for example optic sensors allowing the logic control unit 22 to determine the position of the rolls 15*a*, 15*b* with respect to the bobbin 5.

The logic control unit 22 adjusts the current output from the power circuit 21 to the electric actuators 18*a*, 18*b* based on the position detected by means of the absolute encoders 24*a*, 24*b* (or generally by the means 24 for detecting the position of the rolls) in order to bring the rolls 15*a*, 15*b* to specific predetermined positions depending on the kind of bobbin to be produced.

Figure 2:
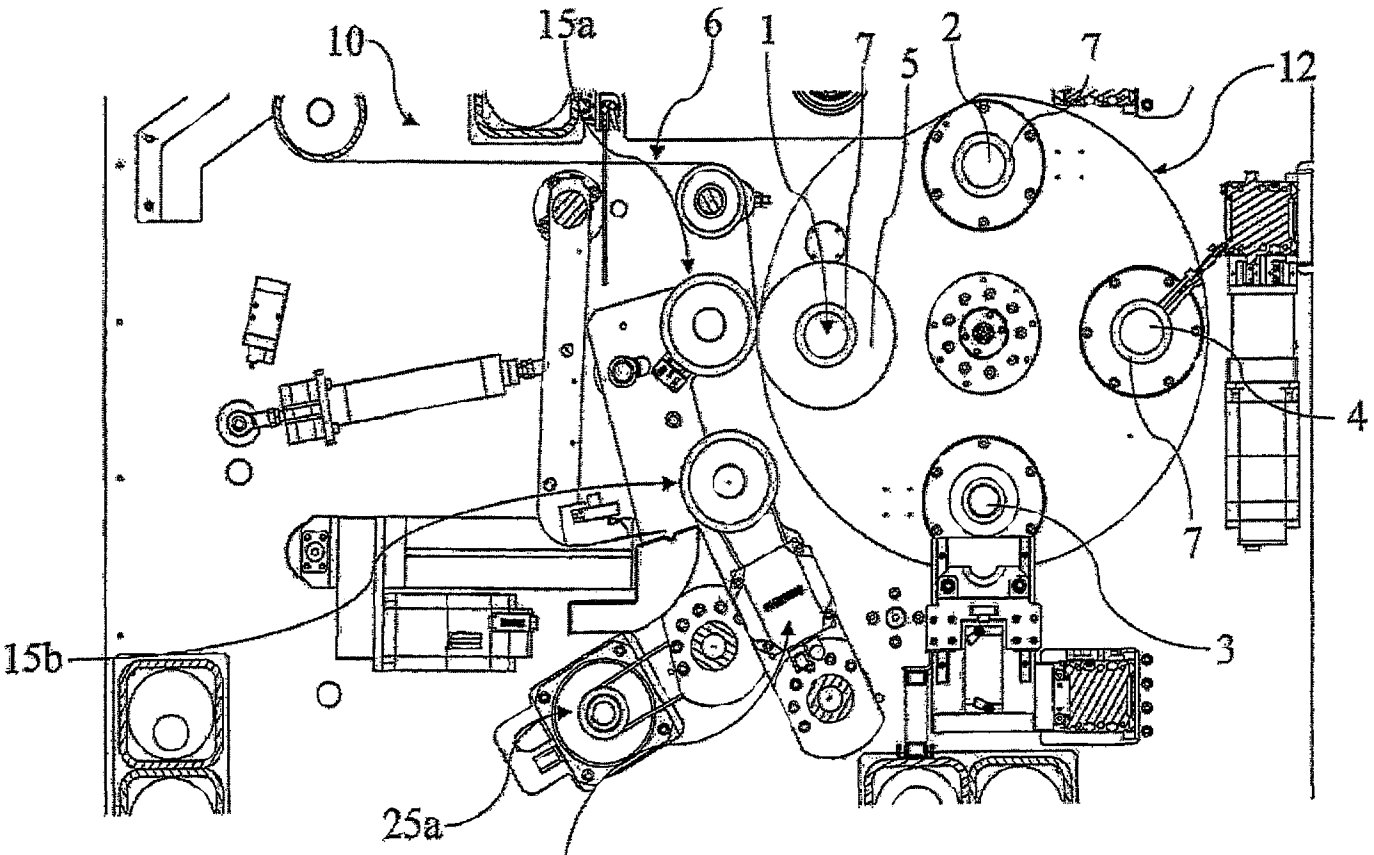
FIGS. 2-6 are sectional views of the winding machine of FIG. 1, taken from the opposite side of the sectional plane, during some operation steps according to a possible implementation of the winding method of the present invention.

FIG. 2 shows the winding machine 10 while operating, when a first reel 1 is in a first operative winding position. In this state, the contact roll 15*a* is in a first proximal contacting position wherein it contacts the bobbin 5 being wound. The contact roll 15*a* is rotated by an electric motor 25*a* coupled with the contact roll 15*a* by means of drive belts. The logic control unit 22 adjusts the current output from the power circuit 21 to the first electric actuator 18*a* depending on the current absorbed which is detected by the ammeter 23*a*, in order to apply a given pressure to the film 6 being wound on the bobbin 5.

The contact roll 15*a* is moved between a first proximal contacting position and at least one second proximal contacting position; as the diameter of the bobbin 5 increases, the roll 15*a* is moved away from the bobbin 5 always keeping it in contact with the latter. The logic control unit 22 determines the position of the contact roll 15*a* with respect to the bobbin 5 being wound by means of the absolute encoder 24*a* of the first electric actuator 18a. For example, the position of the contact roll 15*a* can be evaluated in order to determine the diameter reached by the bobbin 5 being wound.

Figure 3:
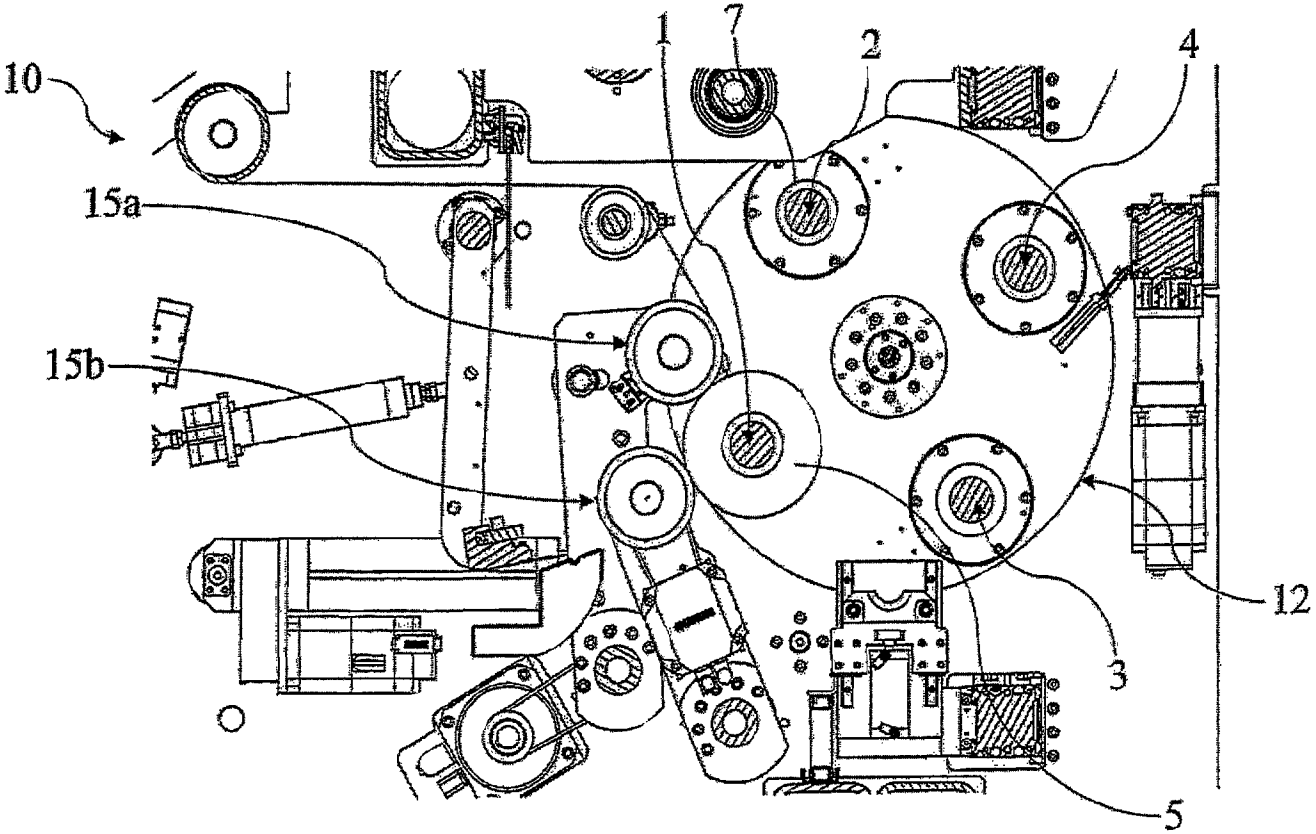

Once the bobbin 5 reaches a predetermined diameter (for example depending on the kind of bobbin to be produced), the reel holder 12 is rotated counterclockwise, for example by about 30°, so as to bring the first reel 1 from the first operative winding position shown in FIG. 2 to a second operative winding position shown in FIG. 3. During the rotation of the reel holder 12, the contact roll 15*a* is kept in contact with the bobbin 5, while the accompanying roll 15*b* is moved by means of the second electrical actuator 18*b* and brought to a given distance D from the bobbin 5 being wound (preferably at a distance D of less than one millimeter, more preferably about half a millimeter from the bobbin 5).

Figure 2B:
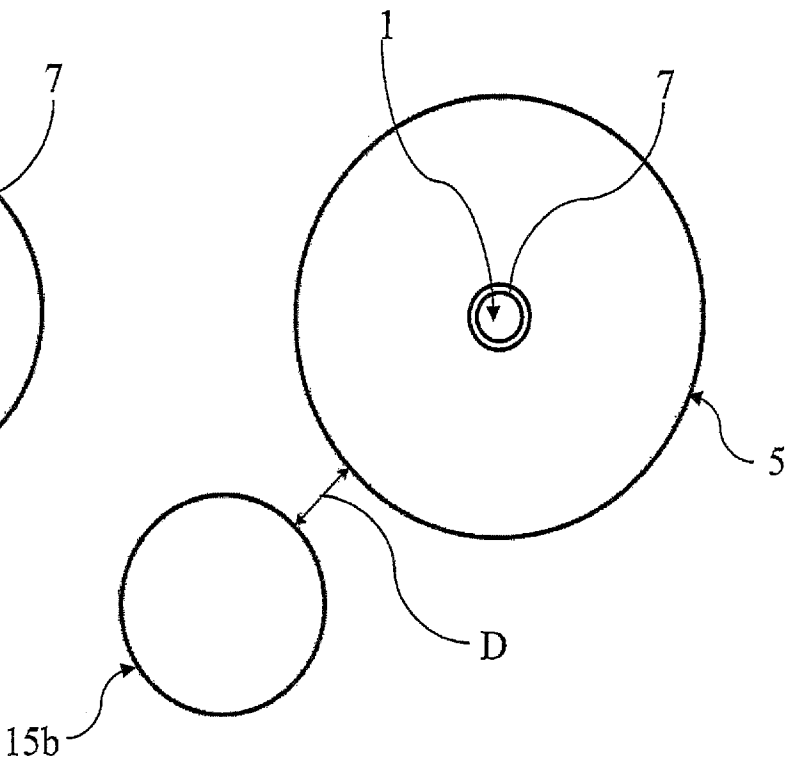
Figure 2A:
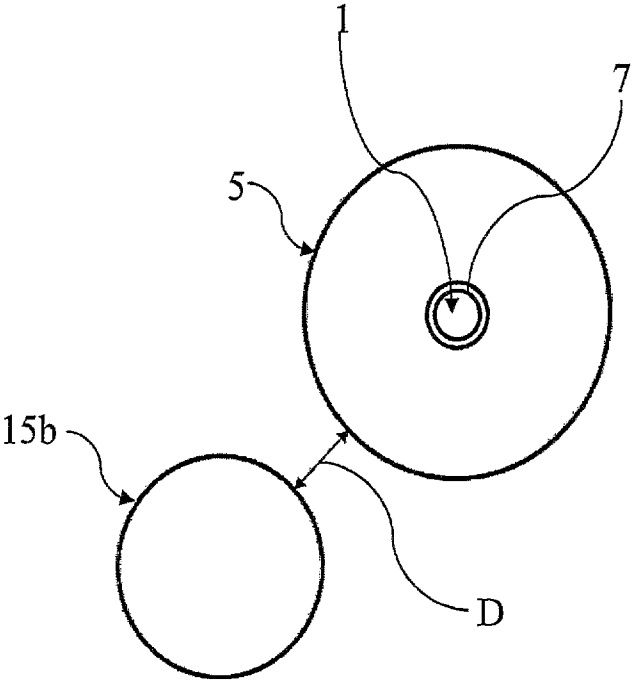

FIGS. 2A and 2B show schematically the accompanying roll 15*b* and the bobbin 5 having two different final diameters. In particular, the bobbin 5 shown in FIG. 2A is of the type having a final diameter minor than the final diameter of the bobbin 5 shown in FIG. 2B.

In both cases, the distance D between the bobbin 5 being wound and the accompanying roll 15*b* is the same. In other words, the second electric actuator 18*b* allows to set the distance D independently from the kind of bobbin to be produced. In this way, the positioning of the accompanying roll 15*b* in contact with the bobbin is carried out in the same way independently from the diameter achieved by the bobbin 5.

The logic control unit 22 determines the position of the second roll 15*b* by means of the second absolute encoder 24*b* and adjusts the supply current to the second electric actuator 18*b* by means of a feedback control so that the accompanying roll 15*b* reaches a given position detected by means of the encoder 24*b*, at a specific distance D from the bobbin 5.

The accompanying roll 15*b* is moved by the electric actuator 18*b* depending on the position the contact roll 15*a* has taken, detected by the encoder 24*a*. The logic control unit 22 can use the position of the contact roll 15*a* (indicating the size of the diameter of the bobbin 5, for example when the reel 1 is in the second winding position) for obtaining the position to be reached by the accompanying roll 15*b* so that the latter is positioned at a given distance D from the bobbin 5.

Then, the accompanying roll 15*b* is brought into contact with the bobbin 5 and at the same time the contact roll 15*a* is brought to a distal position from the bobbin 5. The rolls 15*a*, 15*b* simultaneously contact the bobbin 5 being wound for a split second (typically of the order of a millisecond).

The logic control unit 22 adjusts the supply current to be provided to the second electric actuator 18*b* based on the current absorption detected by the ammeter 23*b* so that the accompanying roll 15*b* keeps applying a predetermined pressure on the bobbin (for example the same pressure previously applied by the contact roll 15*a*). Also the accompanying roll 15*b* is rotated by a similar electric motor 25*b* coupled to the roll 15*b* by means of a drive belt. In this way the first reel 1 keeps winding at the same rotation speed of the contact roll 15*a*.

Figure 4:
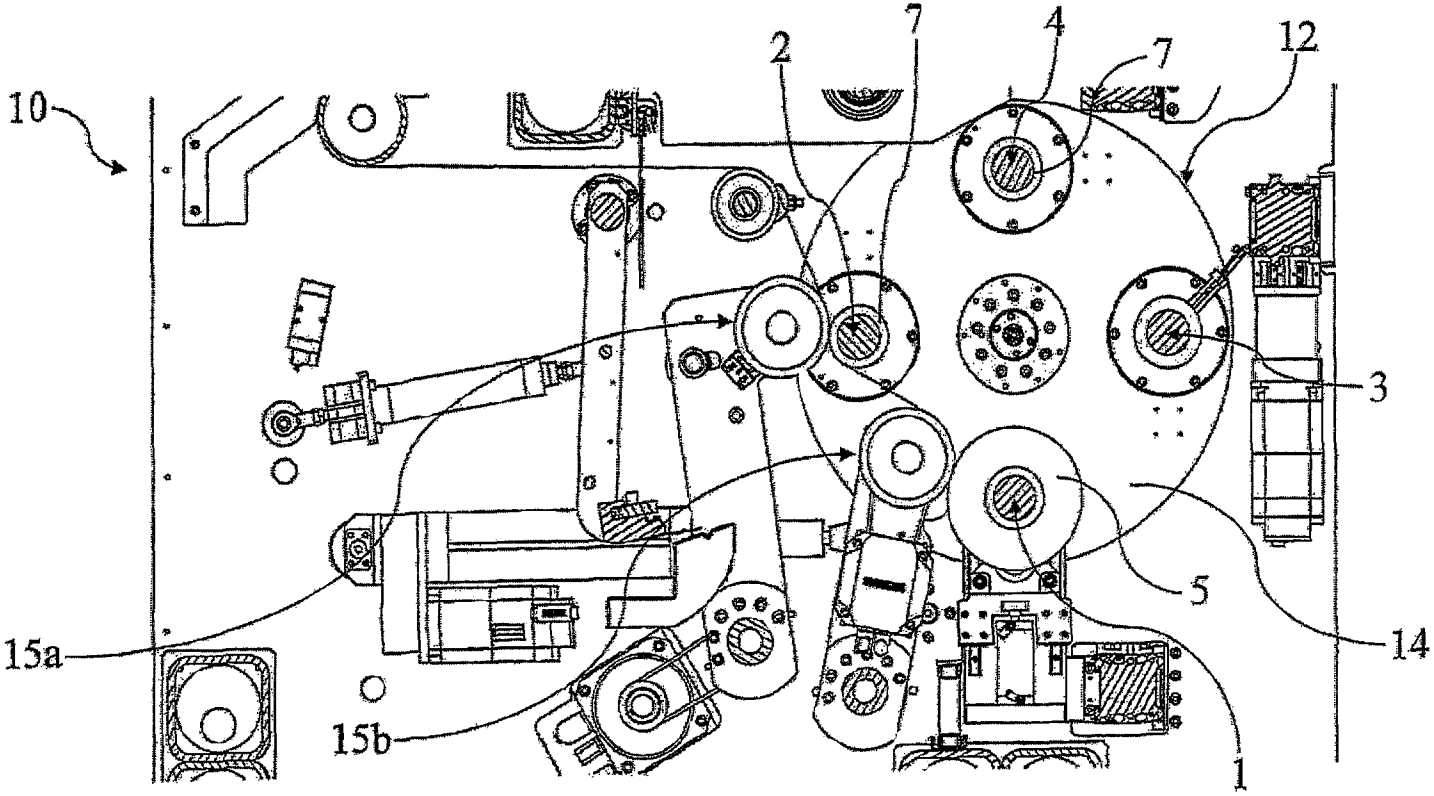

Subsequently, the reel holder 12 rotates more 60° counterclockwise to bring the first reel 1 to an operative unloading position (as shown in FIG. 4). During the rotation of the reel holder 12, the accompanying roll 15*b* is kept in contact with the bobbin 5 so as to apply a similar pressure value on the film 6 being wound around the bobbin 5.

At the same time, a second reel 2 having a new core 7 previously loaded thereon is rotated by a threading-up electric motor (not shown in figures) arranged behind the flange 14 and coupled with the second reel 2 by means of a magnetic coupling.

Preferably, the threading-up operation is carried out during the rotation of the holder 12 to bring the second reel 2 to the operative winding position (while the first reel 1 is brought to the unloading position). In particular, the threading-up electric motor is provided with an electromagnet for coaxially coupling with the second reel 2. During rotation of the holder 12 the threading-up electric motor is integrally moved with the holder 12 so that the electromagnet is still coaxial to the second reel 2. The electromagnet transmits the rotary motion of the threading-up electric motor to the second reel 2, without any contact among the parts, so as to cause the second reel 2 to have a rotation speed close to that of the contact roll 15*a*.

Once the second reel 2 reaches the operative winding position (as shown in FIG. 4), the contact roll 15*a* is moved by means of the first electric actuator 18*a* and brought in contact with the film 6 so that the film 6 is pressed against the core 7 loaded on the second reel 2. Then, the threading-up motor is moved in the opposite way to be brought back to the starting position (i.e. the diametrically opposite position with respect to the unloading position of the bobbin).

Figure 5:
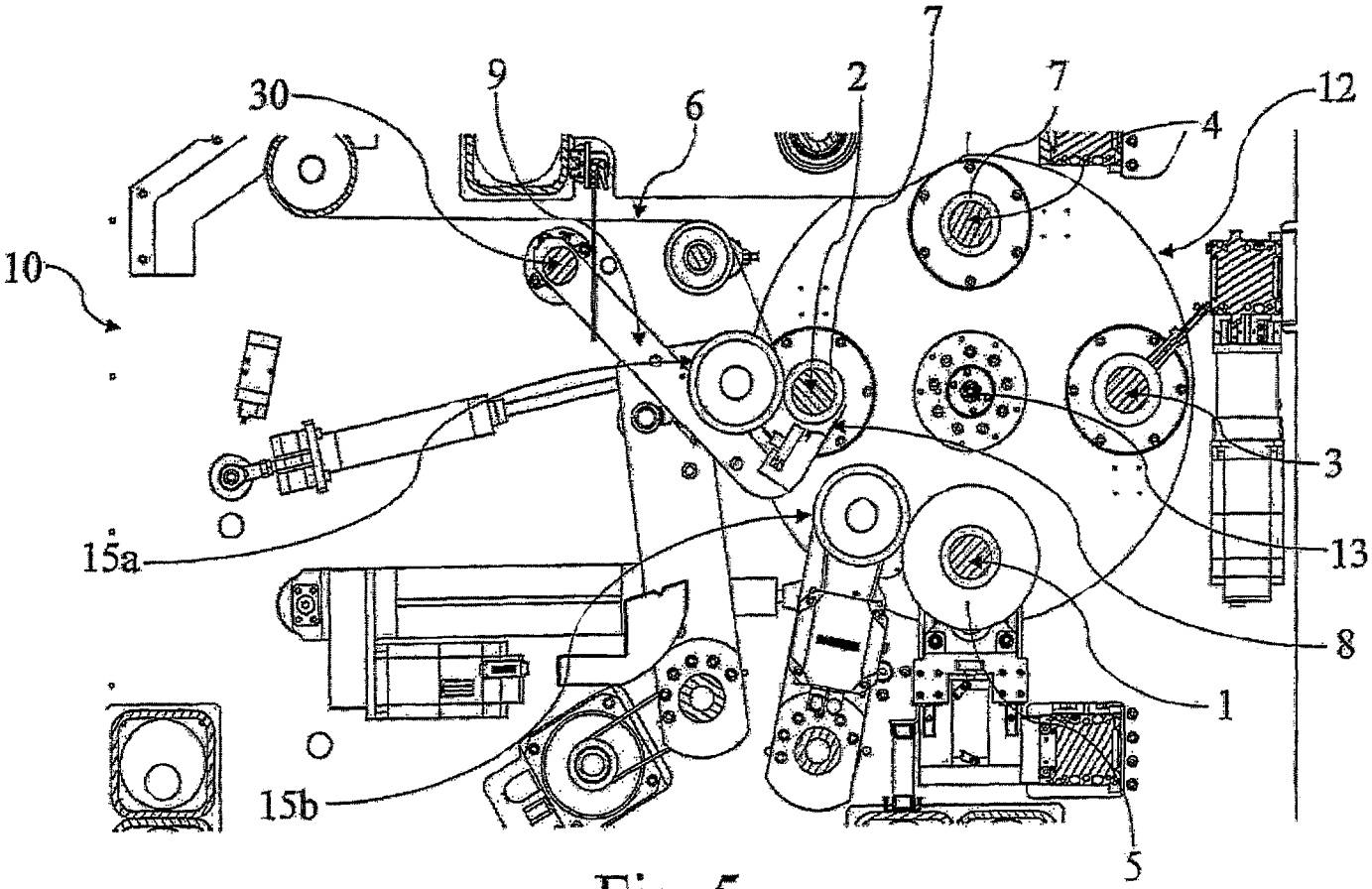

FIG. 5 shows the cutting step of the film 6 by means of a blade 8 coupled with a respective operating arm 9 rotatable around a rotation axis 30 parallel to the rotation axis 13 of the holder 12. As a result of the cut the portion of the film upstream of the cut, with respect to the sliding direction of the film 6, begins to wind around the core 7 loaded on the second reel 2 and the contact roll 15*a* is moved by means of the first electric actuator 18*a* between a first proximal contacting position and at least one second proximal contacting position for applying a predetermined pressure on the film 6 being wound, in a manner similar to that previously described for the first reel 1 in the winding position shown in FIG. 2.

The portion of the film downstream of the cut, with respect to the sliding direction of the film 6, keeps on winding around the bobbin 5 loaded on the first reel 1 in an operative unloading position with the accompanying roll 15*b* being kept in a contact position wherein it contacts the bobbin until the latter is finished.

Once the film portion downstream of the cut is completely wound around the bobbin 5, the accompanying roll 15*b* is brought by means of the second electric actuator 18*b* to a distal position from the bobbin 5 to allow the finished bobbin 5 to be unloaded from the first reel 1 in an unloading position.

After detaching the accompanying roll 15*b* from the finished bobbin 5, the bobbin 5 keeps on rotating by inertia. In order to speed up the unloading of the bobbin 5, the winding machine 10 further comprises a brake, for example of the electromagnetic type, to brake the rotation of the first reel 1 in the unloading position. Preferably, the magnetic brake (not shown in figures) is positioned behind the flange 14 at the unloading position of the bobbin. The electromagnetic brake comprises an electromagnet which, when activated, brakes until stopping the first reel 1 having the finished bobbin loaded thereon, thereby generating parasitic currents by electromagnetic induction, as known per se in the art.

Figure 6:
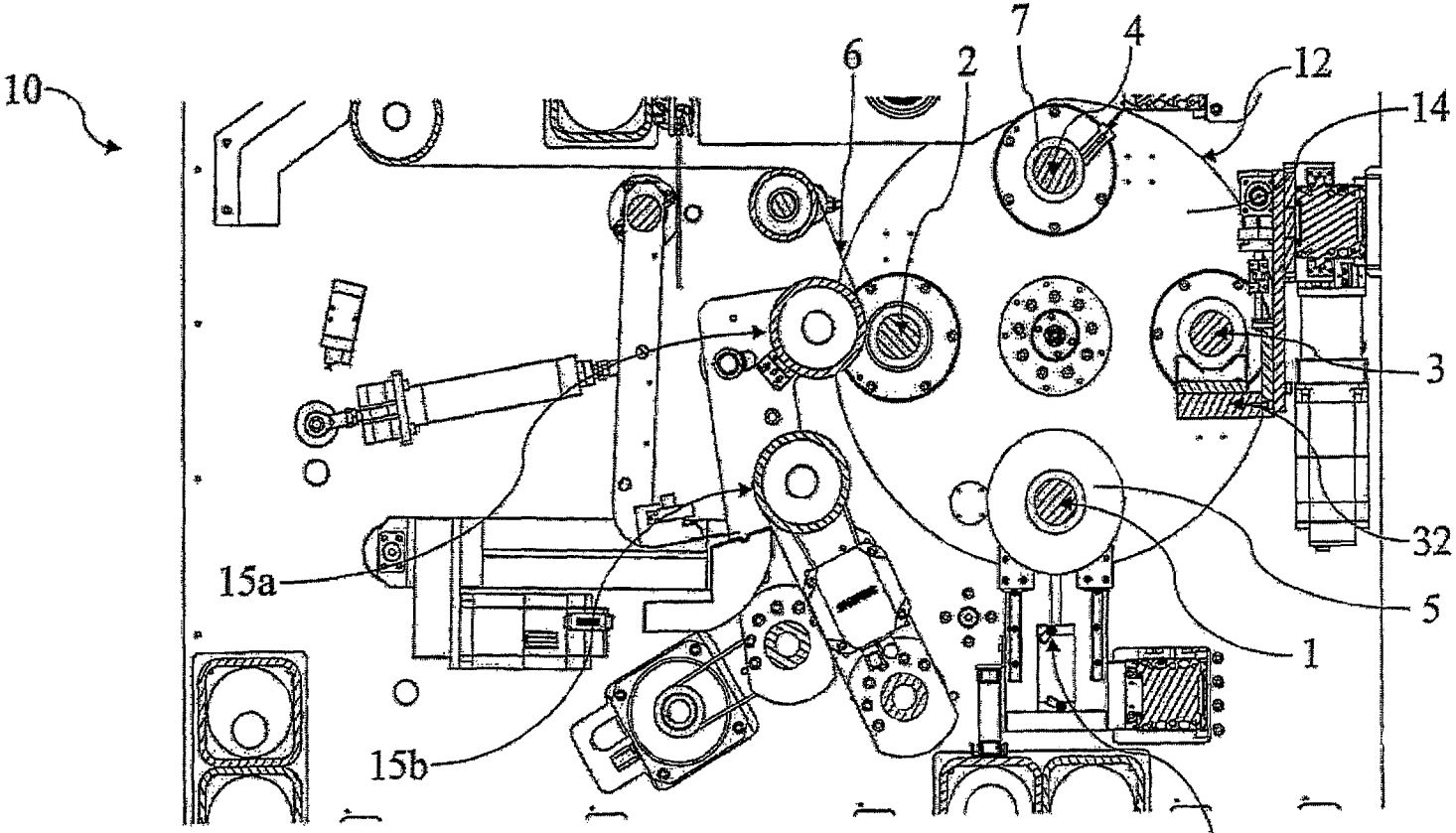

Once the reel 1 carrying the finished bobbin has been stopped, then the unloading step of the bobbin follows (shown in FIG. 6). The bobbin 5 is pulled out of the reel 1 by means of a mechanical arm 31 which is slid along the reel 1. In particular, the bobbin 5 is passed through a hollow (not illustrated) in one of the two flanges 14 and then unloaded onto a platform positioned at a certain height from the bobbin 5, preferably flush with the finished bobbin 5, so as to prevent the bobbin 5 from being bumped while unloaded from the reel 1. The height at which the platform is positioned is calculated depending on the kind of produced bobbin, i.e. depending on the diameter reached by the bobbin at the end of the winding, positioning it so as to allow the reel and bobbin to be mutually extracted from one another. Therefore, the bobbins can be removed from the winding machine through a belt or roll conveyor that takes away the finished bobbins.

At the same time of the unloading step of the finished bobbin, a new core 7 is loaded onto a third reel 3 positioned 90° from the unloading position (in a position diametrically opposite to the operative winding position). By means of an additional mechanical arm 32, the new core 7 is fitted around the third reel 3 in a way similar to the unloading step of the finished bobbin 5 from the first reel 1. In particular, the new core 7 is fitted on the third reel 3 by passing it through a further hollow (not shown) in one of the two flanges 14.

The fourth reel 4, arranged in the position diametrically opposite to the unloading position, carries a core 7 which was loaded during the step of unloading the finished bobbin and loading a new core of the previous cycle.

At the end of the step of unloading the finished bobbin and loading a new core, the arrangement shown in FIG. 2 is back again and the steps of the method are repeated to implement a new cycle.

Although not specifically shown in figures, the reels 1-4 can be of the expandable type, for example mechanically driven, so as to be able to accommodate cores having different diameters. Moreover, although a single core 7 has been referred to for the sake of simplicity, it is also possible that two or more cores are loaded at the same time on the same reel depending on the size of the bobbins to be simultaneously wound.

Figure 7:
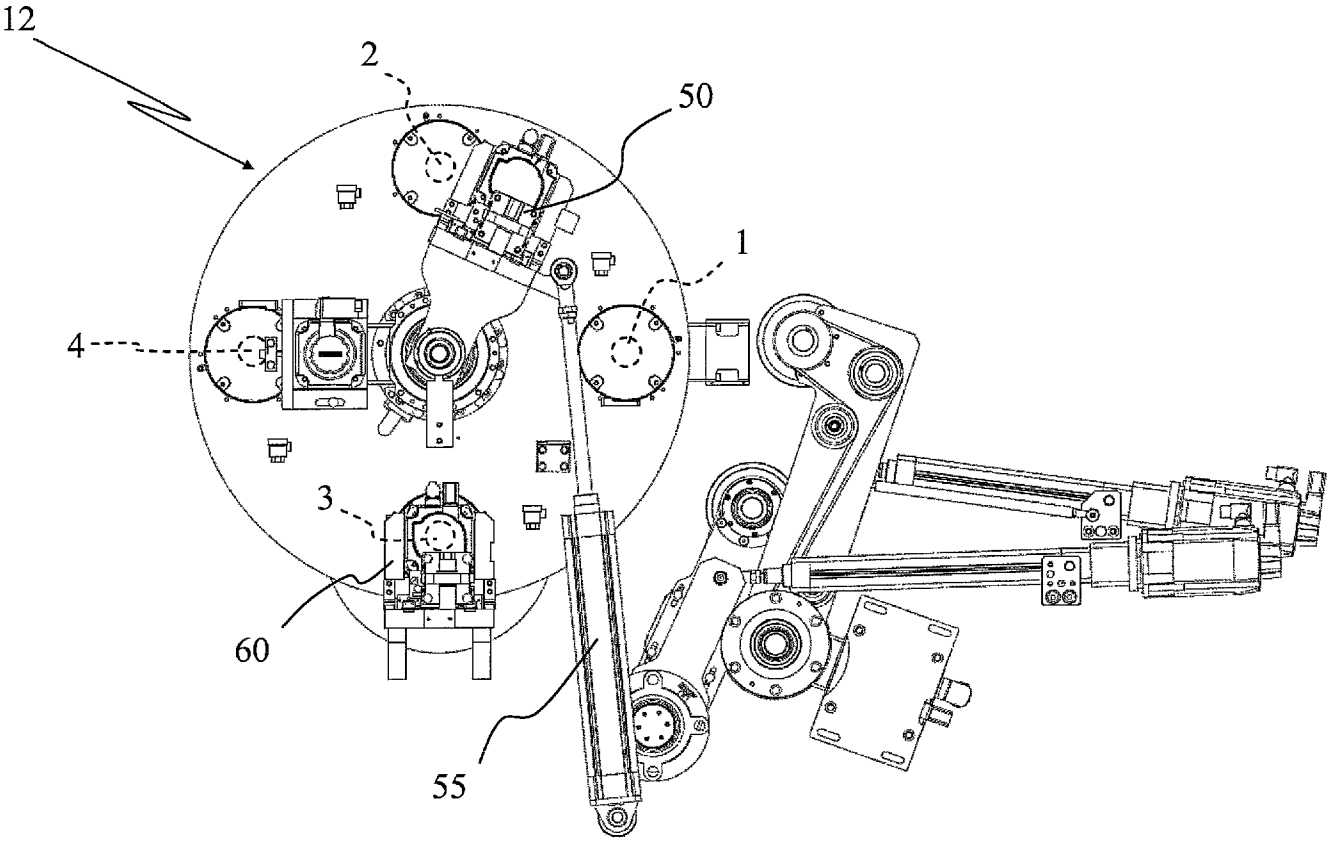
FIG. 7 is a sectional view of an embodiment of the winding machine according to the present invention.

FIG. 7 is a view similar to that of FIG. 1, but taken from the opposite side. The threading-up electric motor is indicated by the reference number 50 and the electromagnetic brake is indicated by the reference number 60; a piston 55 moves the threading-up electric motor 50 from a resting position (that shown in new FIG. 7) to an operative position in which the axis of the threading-up electric motor 50 is aligned with the second reel 2 and can be magnetically coupled to the same.

Figure 8:
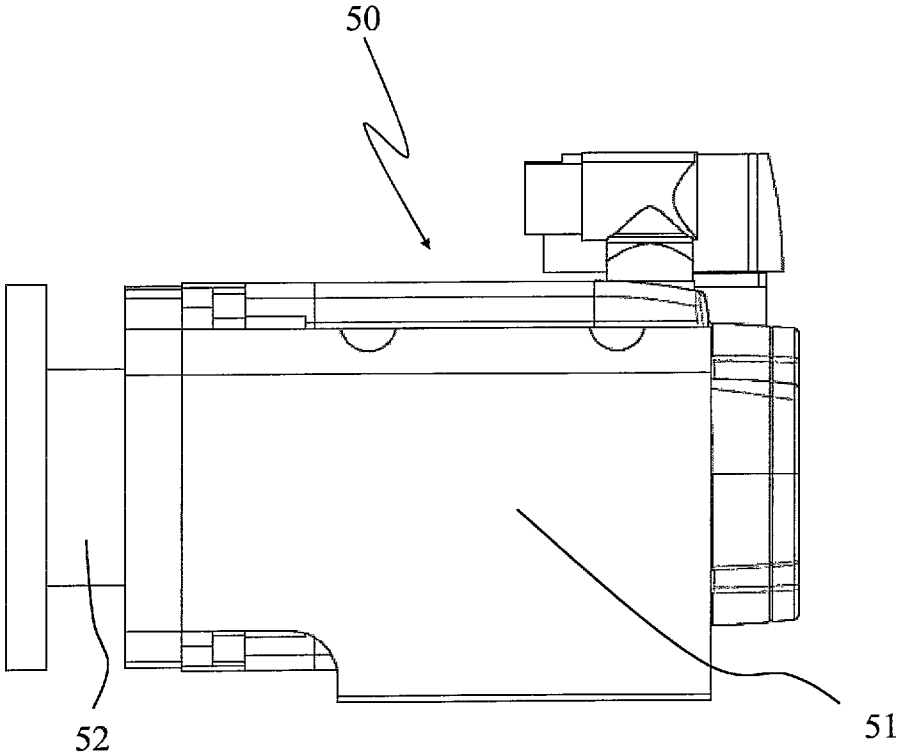
FIG. 8 is a lateral view of the threading-up electric motor 50.
Figure 9:
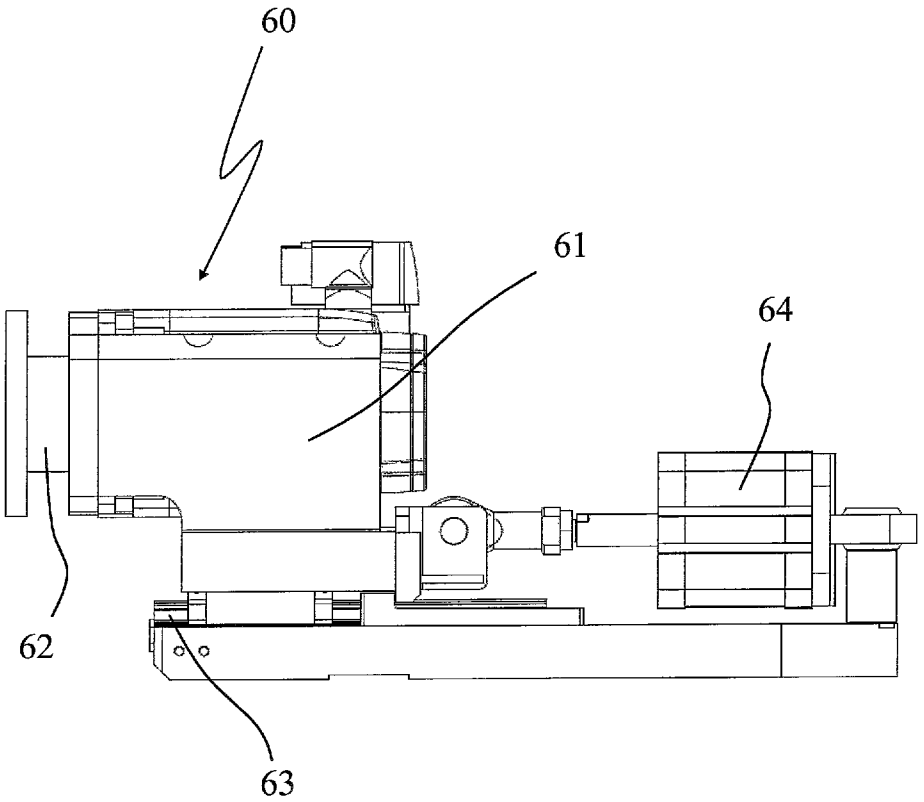
FIG. 9 is a lateral view of the electromagnetic brake 60.

FIG. 8 shows the threading-up electric motor 50 having a motor 51 and an electromagnet 53 to perform the magnetic coupling with the second reel 2;

FIG. 9 shows a lateral view of the electromagnetic brake 60 consisting of an electric motor 61 and an electromagnetic 62. The electromagnetic brake 60 is slidingly mounted on a rail system 63 and moved back and forth by means of a piston 64.

The invention claimed is:

1. A winding machine (10) to wind bobbins (5) of stretch film (6) comprising:

a supporting frame (11), at least one reel holder (12), mounted on said supporting frame (11) and rotatable around its own axis (13), a plurality of reels (1-4) mounted on said at least one holder (12) and integrally rotatable therewith so that at least one first reel (1) is in at least one operative winding position of a bobbin (5), at least one contact roll (15*a*) adapted to cooperate with said at least one first reel (1) in said operative winding position of a bobbin (5), wherein said contact roll (15*a*) is movable between at least one proximal contacting position in which it contacts the bobbin (5) being wound, in order to facilitate the peripheral winding of the stretch film (6) on said bobbin (5), and at least one distal position from said bobbin (5), at least one accompanying roll (15*b*) movable between at least one distal position from the bobbin (5) being wound and at least one proximal contacting position in which it contacts the winding bobbin (5) in order to facilitate the peripheral winding of the stretch film (6) on said bobbin (5) during rotation of said at least one reel holder (12) so that said reel (1) can switch from said operative winding position of the bobbin (5) to an operative unloading position of the bobbin (5), further comprising means (24) for determining the position of said rolls (15*a*, 15*b*) with respect to said bobbin (5) being wound said contact roll (15*a*) and said accompanying roll (15*b*) being respectively coupled with at least one first operating arm (16*a*) and at least one second operating arm (16*b*) which are rotatable around respective rotation axes (17*a*, 17*b*) parallel to the rotation axis of the bobbin, and further comprising electric actuators (18*a*, 18*b*) for rotating said operating arms (16*a*, 16*b*).

2. The winding machine (10) according to claim 1, further comprising at least one electric power circuit (21) for supplying said electric actuators (18*a*, 18*b*) and a logic control unit (22) adapted to control the current output from said at least one electric power circuit (21) to said electric actuators (18*a*, 18*b*).

3. The winding machine (10) according to claim 1, wherein said means (24) for determining the position of said rolls (15*a*, 15*b*) with respect to said bobbin (5) being wound comprise at least one encoder (24*a*, 24*b*) of the absolute type.

4. The winding machine (10) according claim 1, further comprising means (23) for detecting the current absorbed by said electric actuators (18*a*, 18*b*).

5. The winding machine (10) according to claim 4, wherein said logic control unit (22) adjusts the current output from said at least one power circuit (21) to said electric actuators (18*a*, 18*b*) depending on the current absorbed by said electric actuators (18*a*, 18*b*).

6. The winding machine (10) according to claim 1, wherein said electric actuators (18*a*, 18*b*) are of linear type.

7. The winding machine (10) according to claim 1, further comprising a threading-up electric motor adapted to be magnetically coupled with a second reel (2) having a core (7) loaded thereon, for rotating said reel (2).

8. The winding machine (10) according to claim 1, further comprising an electromagnetic brake arranged at said operative position for unloading a finished bobbin (5).

9. A method for the in-line winding of bobbins (5) of stretch film (6) in a machine (10) comprising at least one reel holder (12) mounted on a supporting frame (11) and rotatable around its own axis (13), and a plurality of reels (1-4) mounted on said at least one holder (12) and integrally rotatable therewith so that at least one first reel (1) is in at least one operative winding position of a bobbin (5), the method comprising the steps of:

a) rotating a core (7) on a reel (1) in an operative winding position to wind the film (6) on said core (7);

b) positioning at least one contact roll (15*a*) in at least one proximal contacting position where it contacts the bobbin (5) being wound to facilitate the peripheral winding of the stretch film (6) on said core (7);

c) bringing said reel (1) from said operative winding position of the bobbin (5) to an operative unloading position of the bobbin;

d) positioning at least one accompanying roll (15*b*) in at least one proximal contacting position in which it contacts said bobbin (5) for facilitating the peripheral winding of the stretch film (6) on said bobbin (7) during said step c);

e) transversally cutting the stretch film (6);

f) unloading said bobbin (5), wherein the movement of said contact roll (15*a*) and said accompanying roll (15*b*) is carried out by electric actuators (18*a*, 18*b*), and wherein positions of said contact roll (15*a*) and said accompanying roll (15*b*) with respect to said winding bobbin (5) are determined.

10. The method according to claim 9, wherein said accompanying roll (15*b*) is positioned at a specific distance (D) from said bobbin (5) being wound during said step c).

11. The method according to claim 9, wherein current absorbed by said electric actuators (18*a*, 18*b*) is detected at least during said steps b) and d).

12. The method according to claim 11, wherein said contact roll (15*a*) and said accompanying roll (15*b*) are moved between a first proximal contacting position and at least one second proximal contacting position depending on the current absorbed by said electric actuators (18*a*, 18*b*) for applying to the bobbin (5) a predetermined pressure.

13. The method according to claim 9 further comprising a second reel (2) having a core (7) loaded thereon rotated by means of a threading-up electric motor magnetically coupled with said second reel (2).

14. The method according to claim 9, wherein the rotation of said at least one first reel (1) having a finished bobbin loaded thereon is stopped in said operative unloading position by means of an electromagnetic brake.

* * * * *